United States Patent [19]

Pringle

[11] 4,444,266

[45] Apr. 24, 1984

[54] DEEP SET PISTON ACTUATED WELL SAFETY VALVE

[75] Inventor: Ronald E. Pringle, Houston, Tex.

[73] Assignee: Camco, Incorporated, Houston, Tex.

[21] Appl. No.: 463,462

[22] Filed: Feb. 3, 1983

[51] Int. Cl.[3] ..... E21B 34/10

[52] U.S. Cl. ..... 166/324; 166/321; 251/63.4

[58] Field of Search ..... 166/324, 321, 319, 369, 166/373, 374, 375, 383, 386; 251/63.4, 284, 282

[56] References Cited

U.S. PATENT DOCUMENTS

| | | | |
|---|---|---|---|
| 3,986,554 | 10/1976 | Nutter | 251/63.4 X |
| 4,161,219 | 7/1979 | Pringle | 166/324 |
| 4,373,587 | 2/1983 | Pringle | 166/324 |

*Primary Examiner*—Ernest R. Purser
*Assistant Examiner*—Thuy M. Bui
*Attorney, Agent, or Firm*—Fulbright & Jaworski

[57] ABSTRACT

A well safety valve for controlling the fluid flow through a well tubing in which at least one piston having a small cross-sectional area for reducing the effect of high hydrostatic forces controls the opening and closing of the valve. The piston has a piston rod extending upwardly from the piston for connection to the tubular member controlling the valve whereby the piston and piston rod are acted on in tension by hydraulic control fluid and avoids subjecting the small piston to compression loads. A stop is provided on the piston on the side remote from the upwardly extending piston rod for preventing compression loading on the piston in the event the tubing pressure is greater than the control fluid pressure. The connection between the piston rod and the tubular member includes at least one telescopically movable elongate member having a greater cross-sectional area than the piston rod and is connected between the piston rod and the tubular member. The elongate member is pressure balanced as to both the hydraulic control fluid and the tubing pressure in the valve bore. A lost motion connection is between the piston rod and the elongate member for allowing the piston to assist in closing the valve if necessary but avoiding compressional loads on the rod.

7 Claims, 8 Drawing Figures

DEEP SET PISTON ACTUATED WELL SAFETY VALVE

BACKGROUND OF THE INVENTION

Subsurface tubing well safety valves are used in wells for shutting off the flow of well fluid through the well tubing in which the valve is biased to a closed position and is opened by a piston in response to hydraulic control fluid applied from the well surface. However, the means biasing the valve to a closed position must overcome the hydrostatic head in the hydraulic control line to the piston. My prior U.S. Pat. No. 4,161,219 discloses the use of one or more pistons having a small cross-sectional area which reduces the hydrostatic force of the hydraulic control fluid whereby the safety valve may be used at greater depths in the well. Therefore, by reducing the cross-sectional area of the pistons, the hydrostatic forces may be reduced. However, reducing the cross-sectional area of the control pistons increases the compression loading in the piston rods and can cause the piston rods to bend or buckle thereby causing the safety valve to fail to operate.

The present invention is directed to an improved piston actuated subsurface tubing safety valve which utilizes a small area piston for reducing the hydrostatic forces but provides a structure in which the piston rod operates in tension instead of compression thereby allowing the control pistons to carry greater overall loads.

The present invention is directed to a well tubing safety valve for controlling the fluid flow through a well tubing and includes a tubular housing having a bore therein and a valve closure member moving between open and closed positions for closing the fluid flow through the bore. A longitudinal tubular member telescopically moves in the housing coaxially with the bore for controlling the movement of the valve closure member. Biasing means biases the tubular member in a first direction for causing the valve closure member to move to the closed position. The present invention is directed to the improvement in means for moving the tubular member in a second direction for opening the valve closure member and includes at least one piston telescopically movable in the housing which is in communication with hydraulic fluid extending through the well surface for actutating the member in the second direction to open the valve member. The piston has a small cross-sectional area for reducing the hydrostatic force of the hydraulic fluid acting on the piston. The piston includes a piston rod extending upwardly from the piston for connection to the tubular member whereby the piston rod and piston is acted on in tension by the hydraulic fluid to move the tubular member to the open position thereby allowing the piston rod and piston to carry greater loads than if they were operating in compression.

Still a further object of the present invention is wherein the connection between the piston rods and the tubular member includes at least one telescopically movable elongate member having a greater cross-sectional area than the piston rod and is connected between the piston rod and the tubular member. The elongate member is pressure balanced relative to both the hydraulic fluid and the tubing pressure in the bore whereby the elongate member can be of a sufficient area to withstand compression loads but is not affected by the hydraulic control fluid or the tubing pressure.

Yet a still further object of the present invention is wherein the elongate member includes a piston at each end and a hole extending through the elongate member for balancing the hydraulic control fluid on the elongate member and the elongate member is exposed to the tubing pressure between the elongate member pistons thereby balancing the tubing pressure on the elongate member.

Still a further object of the present invention is the provision of a stop means on the piston on the side remote from the upwardly extending piston rod for preventing compression loading on the piston and piston rod in the event the tubing pressure is greater than the pressure of the hydraulic control fluid.

Yet a still further object of the present invention is the provision of a lost motion connection between the piston rod and the elongate member for preventing compression loading on the piston rod during the closing of the valve, but still allowing the piston and piston rod to assist in closing the valve in the event that the tubular member becomes stuck.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present improvement in a subsurface well tubing safety valve will be shown, for the purposes of illustration only, as incorporated in the flapper-type tubing retrievable safety valve, it will be understood that the present invention may be used for other types of safety valves and safety valves having various types of valve closing elements.

Figure 1A:
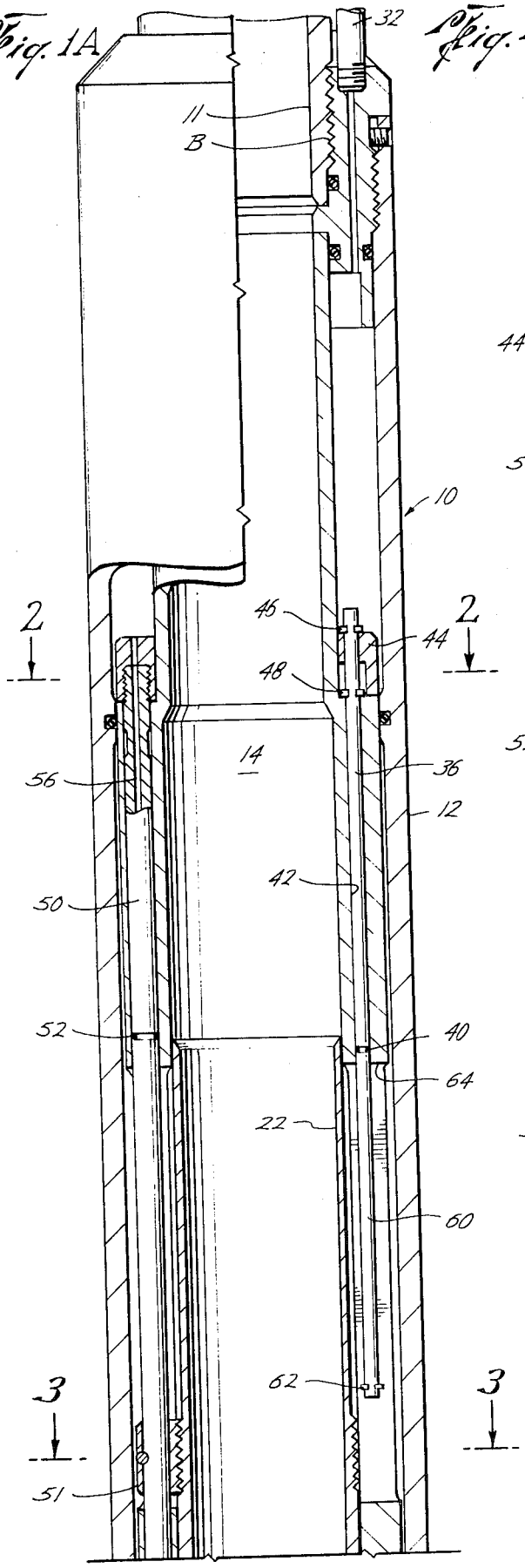
FIGS. 1A, 1B and 1C are continuations of each other and are elevational cross sections, partly fragmentary, of the safety valve of the present invention shown in the open position.
Figure 1B:
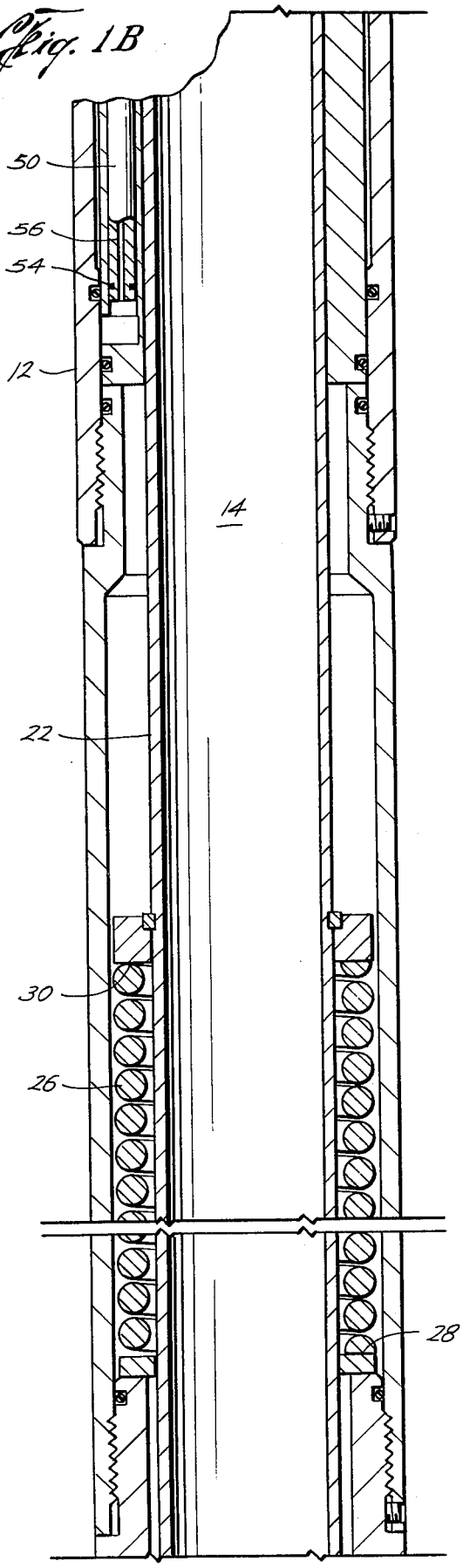
Figure 1C:
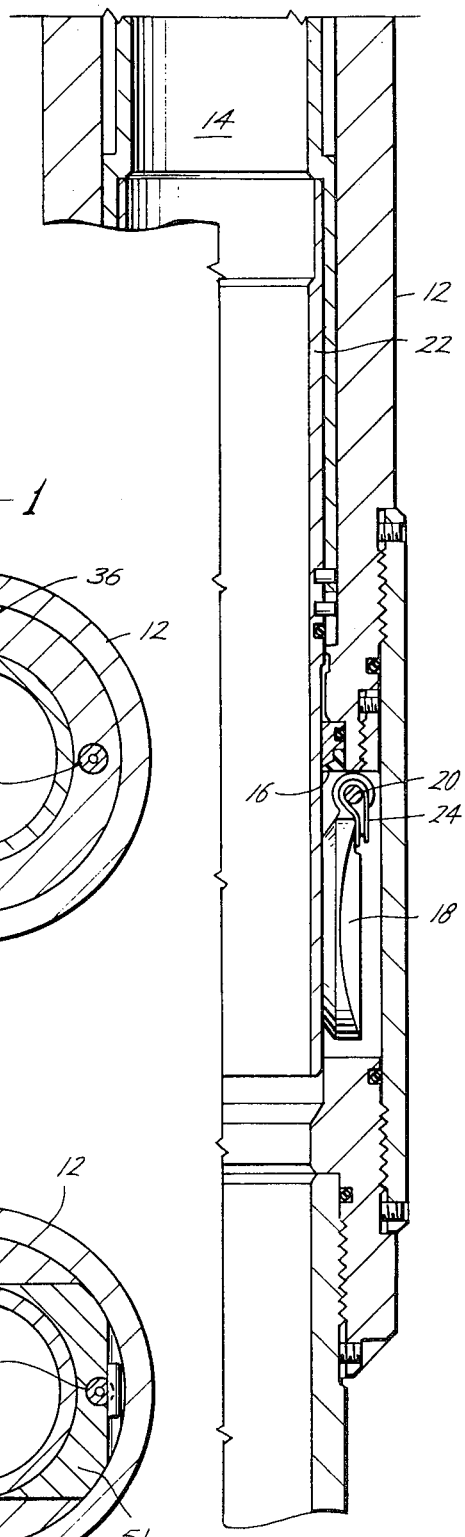

Referring now to the drawings, and particularly to FIGS. 1A, 1B and 1C, the subsurface safety valve of the present invention is generally indicated by the reference numeral 10 and is shown as being of a non-retrievable type for connection in a well conduit or well tubing 11 such as by a threaded box B at one end and a threaded pin (not shown) at the other end for connecting the safety valve 10 directly into the tubing 11 of an oil and/or gas well. The safety valve 10 generally includes a body or housing 12 adapted to be connected in a well tubing to form a part thereof and to permit well production therethrough under normal operating conditions but in which the safety valve 10 may close or be closed in response to abnormal conditions such as might occur when the well over-produces, blows wild, or in the event of failure of well equipment.

The safety valve 10 generally includes a bore 14, an annular valve seat 16 (FIG. 1C) positioned about the bore 14, a valve closure element such as a flapper valve 18 connected to the body 12 by a pivot pin 20. Thus when the flapper 18 is in the upper position and seated on the valve seat 16 (FIG. 4C), the safety valve 10 is closed blocking flow upwardly through the bore 14 and the well tubing 11. A sliding tube or tubular member 22 is telescopically movable in the housing 12 and through the valve seat 16.

As best seen in FIG. 1C, when the tubular member 22 is moved to a downward position, the member 22 pushes the flapper 18 away from the valve seat 16. Thus, the valve 10 is held in the open position so long as the sliding tube 22 is in the downward position. When the member 22 is moved upwardly, the flapper 18 is allowed to move upwardly on to the seat 16 by the action of a spring 24 and also by the action of fluid flow moving upwardly through the bore 14 of the housing 12.

Various forces may be provided to act on the tubular member 22 to control its movement so that under operating conditions the tubular member 22 will be in the downward position holding the flapper 18 away from and off of the valve seat 16 so that the valve 10 will be open. When abnormal conditions occur, the tubular member 22 will be moved upwardly allowing the flapper 18 to close shutting off flow through the valve 10 and well tubing 11. Thus, biasing means, such as a spring 26, or a pressurized chamber (not shown), may act between a shoulder 28 on the valve body 12 and a shoulder 30 connected to the tubular member 22 for yieldably urging the tubular member 22 in an upward direction to release the flapper 18 for closing the valve 10.

The safety valve 10 is controlled by the application or removal of a pressurized fluid, such as hydraulic control fluid, through a control path or line such as control line 32 extending to the well surface or the casing annulus (not shown) which supplies a pressurized hydraulic control fluid to a piston (which will be described in greater detail) which in turn acts on the tubular member 22 to move the tubular member 22 downwardly forcing the flapper 18 off of the seat 16 and into the full open position. If the fluid control pressure in the conduit 32 is reduced sufficiently relative to the forces urging the tubular member 22 upwardly, the tubular member 22 will be moved upwardly beyond the seat 16 allowing the flapper 18 to swing and close the seat 16.

The above description of a tubing safety valve is generally known. However, it is noted that the safety valve 10 will be positioned downhole in a well and the control line 32 will be filled with a hydraulic fluid which exerts a downward force on a control piston in the valve 10 at all times regardless of whether control pressure is exerted or removed from the control line 32 because of the hydrostatic pressure in the control line 32. This means that the upwardly biasing forces must be sufficient to overcome the hydrostatic pressure forces existing in the control line 32 which limits the depth at which the safety valve 10 may be placed in a well. The safety valve in my U.S. Pat. No. 4,161,219 provided one or more rod type pistons having small cross-sectional areas which reduce the hydrostatic forces of the fluid in the control line 32 and thus allowed the safety valve to be operable at greater depths. However, the cross-sectional area of the prior art pistons must be sufficiently large to withstand the compression forces to which they are subjected or they will bend or buckle and cause the safety valve to fail to operate. Therefore, in order to withstand the compression load, the prior art pistons were limited in the depth at which they could be operated because of their size requirements to withstand the forces exerted on them.

Figure 2:
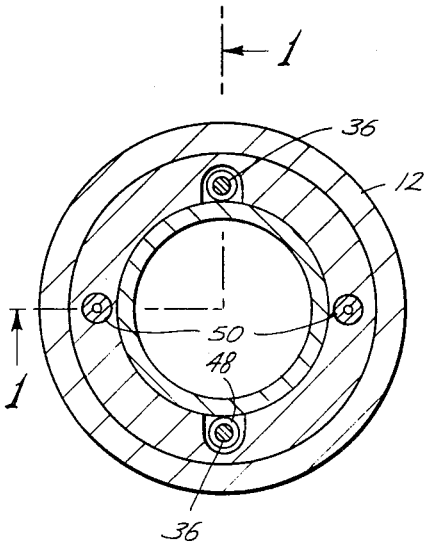
FIG. 2 is a cross-sectional view taken along the line 2—2 of FIG. 1A.
Figure 3:
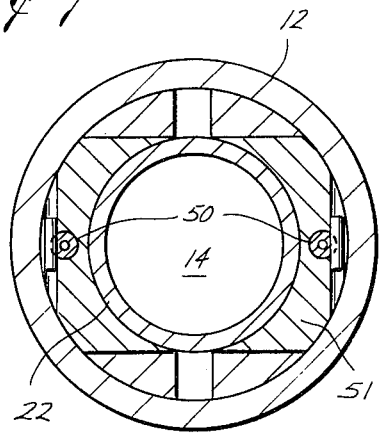
FIG. 3 is a cross-sectional view taken along the line 3—3 of FIG. 1A, and FIGS. 4A, 4B and 4C are continuations of each other and are similar to FIGS. 1A, 1B and 1C but showing the safety valve of the present invention in the closed position.

The present invention is directed to an improvement in operating the tubular member 22 by utilizing one or more control pistons which are operated in tension, instead of compression, thereby allowing the pistons to withstand greater forces and yet provide a small cross-sectional area for reducing hydrostatic loading. Referring now to FIGS. 1A and 2, one or more, and preferably two, circular rods 36 are provided having a suitable seal to form a piston 40 thereon which is telescopically movable within a cylinder 42 in the housing 12 outside of the tubular member 22. The pistons 40 are in communication with hydraulic fluid in the control line 32 extending to the well surface for actuating the pistons 40 downwardly. In addition, the second sides of the pistons 40 are exposed to fluid pressure in the bore 14 of the housing 12 which is the pressure in the tubing 11 which acts on the pistons 40 in a direction tending to move the pistons 40 upwardly. The pressure in bore 14 flows around member 22 and into the interior of the housing 12 as there are no seals between tubular member 22 and housing 12. The pistons have a small cross-sectional area for reducing the hydrostatic forces of the hydraulic fluid acting in the control line 32. One important feature of the present invention is that the rod 36 extends upwardly from the piston 40 for providing a connection to the tubular member 22. Therefore, when pressure is exerted in the control line 30 the control hydraulic fluid acts on the pistons 40 to operate the piston rods 36 in tension thereby avoiding compression loading on the piston rods 36 and allowing the piston rods 36 to carry a greater load. This in turn allows the cross-sectional area of the piston rods 36 and pistons 40 to be minimized thereby allowing the safety valve 10 to be set at much greater depth than prior art safety valves. For example, in one embodiment of a 3½ inch size safety valve 10, the cross-sectional areas of two pistons 40 were 0.098 square inches.

The connection between the piston rods 36 and the tubular member 22 preferably includes a circular ring 44 telescopically movable in the housing 12. Preferably, the connection between the piston rods 36 and the rings 44 is by a lost motion connection such as first and second stop 46 and 48, respectively, connected to the piston rods 36 for engagement with the ring 44 as the piston rods 36 move downwardly and upwardly, respectively. When the piston 40 moves downwardly by pressure from the control line 32, the stop 46 engages the ring 44 moving it downward to actuate the tubular member 22 as will be more fully described hereinafter. The lower stop 48 only contacts the ring 44, as will be described more fully hereinafter, to assist in opening the safety valve 10 in the event the tubular member sticks on opening.

Referring to FIGS. 1A and 1B, one or more elongate members 50 are provided telescopically movable in the housing 12 having one end connected to the ring 44 and in turn connected to the flow tube 22 such as by connector 51 whereby the members 50 move with the flow tube 22. The elongate members 50 are pressure balanced relative to both the hydraulic control fluid from the line 32 and also with respect to the tubing pressure in the bore 14 of the housing 12. It is also to be noted that the elongate members 50 are of a greater cross-sectional area than the piston rods 36 and are therefore capable of withstanding higher compression loading. Because the elongate members 50 are pressure balanced the hydraulic control fluid and the tubing pressure has no effect on their movement. Each member 50 includes seals 52 and 54 forming pistons at each end. The members 50 also include a hole 56 in communication with the hydraulic control fluid from line 32 which extends entirely through the members 50 whereby the hydraulic control fluid exerts equal and opposite forces on the pistons 52 and 54. Similarly, the tubing pressure in the bore 14 of the housing 12 flows around the tubular member 22 and is exposed to the outside of the elongate members 50 and exerts equal and opposite forces on the pistons 52 and 54.

In addition, a piston rod extension 60 is provided extending from each piston 40 downwardly and includes a stop 62 which engages a shoulder 64 (FIG. 4A) when the valve 10 is moved to the fully open position. This insures that the piston rod 36 will not be subjected to a compression loading when the safety valve 10 is opened and the tubing pressure in the bore 14 is greater than the pressure of the hydraulic control fluid in line 32.

In operation, when the hydraulic control fluid in control line 32 is pressured up, the pistons 40 move downwardly, the stop 46 engages the ring 44, the elongate members 50 are carried downwardly and move the tubular member 22 downwardly through the flapper 18 and open the safety valve 10. The piston rods 36 are operated in tension and therefore can be small enough to minimize the effect of hydrostatic fluid forces. On the other hand, the elongate members 50 are made larger and strong enough to carry compression loading, but are pressure balanced and are not affected by hydrostatic forces in the control line 32.

Figure 4A:
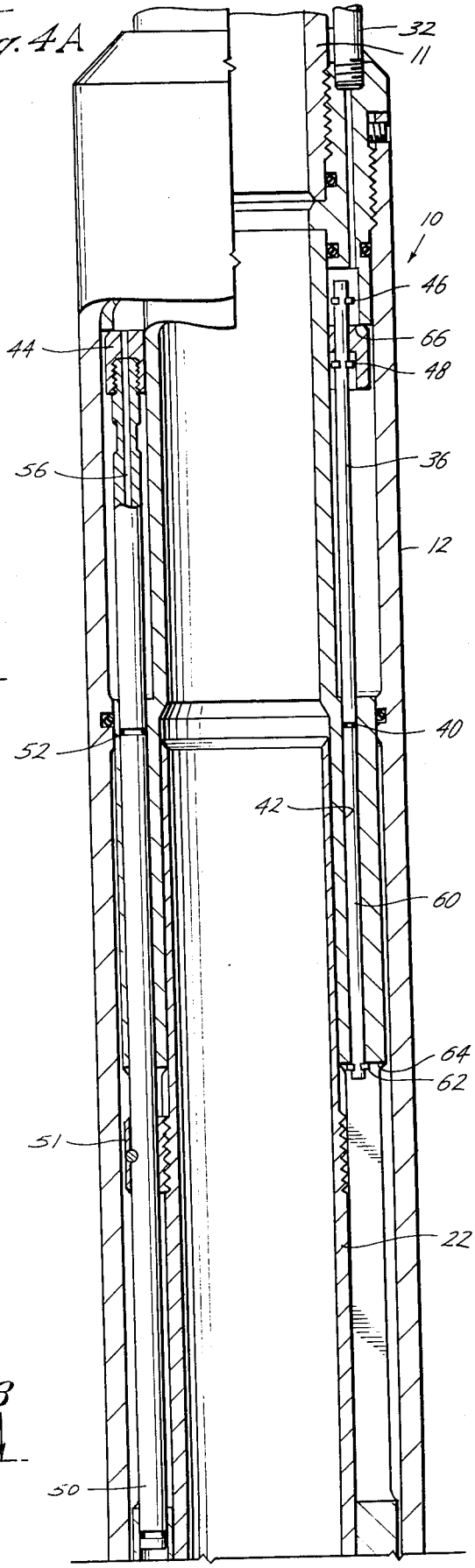
Figure 4B:
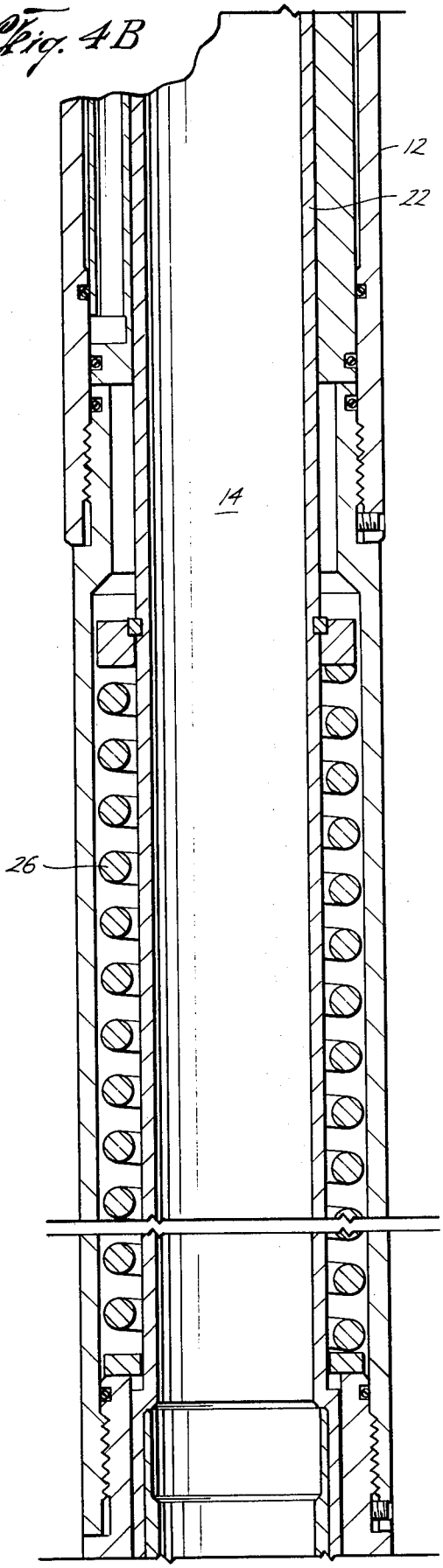
Figure 4C:
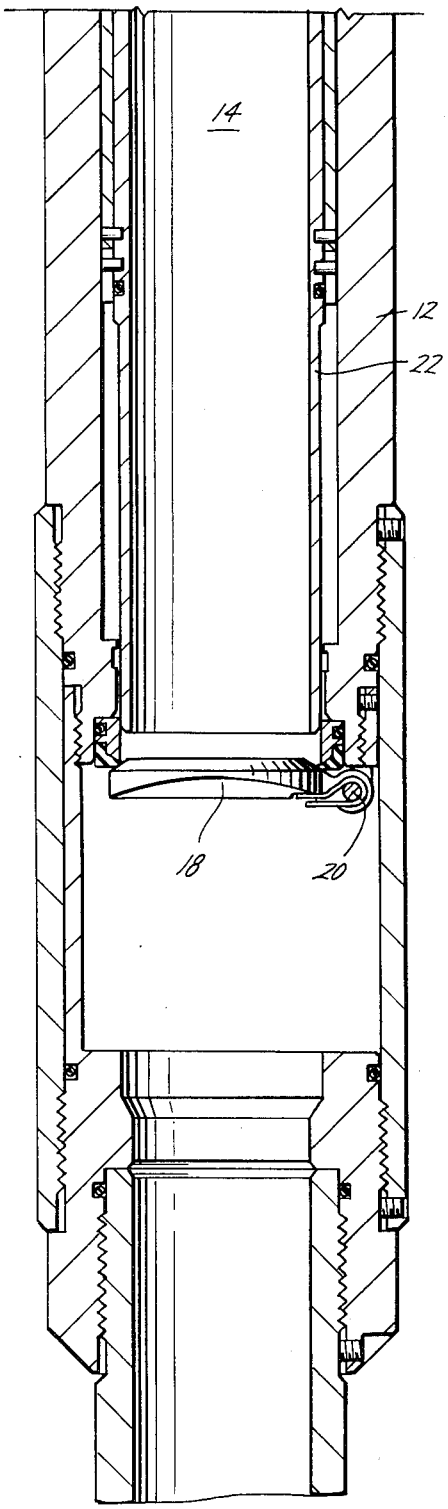

When it is desired to close the valve 10, as best seen in FIGS. 4A, 4B and 4C, the pressure in the control line 32 is released and the biasing means, such as the spring 26, moves the tubular member 22 upwardly, which in turn moves the elongate members 50 upwardly, causing the ring 44 to engage the stops 46 carrying the pistons 40 upwardly and the flapper 18 closes. In FIG. 4A, it is noted that the ring 44 bottoms out on a shoulder 66 in the housing 12 but the stops 62 on the piston rods 60 engage the shoulder 64 in the housing 12 to space the stop 48 from the bottom of the ring 44 thereby preventing the tubing pressure in the bore 14 from butting a compression loading on the small area piston rod 36.

However, in the event that the tubular member 22 becomes stuck in the housing 12 and cannot be moved to the closed position by the biasing spring 26, the tubing pressure in the bore 14 of the housing 12, which is exposed to the bottom of the pistons 40 will act on the pistons 40 to move the piston rods 36 upwardly whereby the stops 48 will engage the ring 44 and assist the biasing spring 26 to move the tubular member 22 upwardly opening the valve. While this action undesirably places the piston rods 36 under a compression loading, this is not a normal cycle of operation for the safety valve 10 but is only used to prevent the valve from becoming stuck in the open position.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well tubing safety valve for controlling the fluid flow through a well tubing and including a tubular housing having a bore therein and a valve closure member moving between open and closed positions for controlling the fluid flow through the bore, a longitudinal tubular member telescopically movable in the housing coaxially with the bore for controlling the movement of the valve closure member, means for biasing the tubular member in a first direction for causing the valve closure member to move to the closed position, the improvement in means for moving the tubular member in a second direction for opening the valve closure member comprising, at least one piston telescopically movable within and having its longitudinal axis within the housing and outside of the tubular member, said piston being in communication with hydraulic fluid extending to the well surface for actuating said member in the second direction to open said valve member and the piston has a small cross-sectional area for reducing the hydrostatic force of the hydraulic fluid acting on the piston, said piston having a piston rod extending upwardly from the piston for connection to the tubular member whereby the piston rod and piston are acted on in tension by the hydraulic fluid to move the tubular member to the open position thereby allowing the piston rod and piston to carry greater loads.

2. The apparatus of claim 1 wherein the connection between the piston rod and the tubular member includes, at least one telescopically movable elongate member having a greater cross-sectional area than the piston rod and connected between the piston rod and said tubular member, said elongate member being pressure balanced relative to both the hydraulic fluid and tubing pressure in the bore.

3. The apparatus of claim 2 wherein the elongate member includes a piston at each end and a hole extending through the elongate member for balancing the hydraulic fluid and said elongate member exposed to tubing pressure between the elongate member pistons for balancing the tubing pressure.

4. The apparatus of claim 1 including, stop means on said piston on the side remote the upwardly extending piston rod for preventing compression loading on the piston and piston rod in the event the tubing pressure is greater than the pressure of the hydraulic fluid.

5. The apparatus of claim 1 wherein the connection of the upwardly directed piston rod to the tubular member includes a lost motion connection.

6. In a well tubing safety valve for controlling the fluid flow through a well tubing and including a tubular housing having a bore therein and a valve closure member moving between open and closed positions for controlling the fluid flow through the bore, a longitudinal tubular member telescopically movable in the housing coaxially with the bore for controlling the movement of the valve closure member, means for biasing the tubular member in a first direction for causing the valve closure member to move to the closed position, the improvement in means for moving the tubular member in a second direction for opening the valve closure member comprising, at least one piston telescopically movable in the housing, one side of the piston being in communication with hydraulic fluid extending to the well surface for actuating said member in the second direction to open said valve closure member, the second side of the piston being exposed to fluid pressure in the tubing pressure valve housing tending to move the piston in the first direction, said piston having a small cross-sectional area for reducing the hydrostatic force of the hydraulic fluid acting on the piston, said piston having a piston rod extending upwardly from the piston for connection to the tubular member whereby the piston rod and piston are acted on in tension by the hydraulic fluid to move the tubular member to the open position, at least one telescopically movable elongate member having a greater cross-sectional area than the piston rod and connected between the piston rod and said tubular member, a lost motion connection between the piston rod and said elongate member, said elongate member being pressure balanced relative to both the hydraulic fluid and the tubing pressure in the bore of the housing, and stop means on the piston on the side remote from the upwardly extending piston rod for preventing compression loading on the piston and piston rod in the event the tubing pressure is greater than the pressure of the hydraulic fluid.

7. The apparatus of claim 6 wherein the elongate member includes a piston at each end and a hole extending through the elongate member for balancing the hydraulic fluid and said elongate member is exposed to tubing pressure between the elongate member pistons for balancing the tubing pressure.

* * * * *